US005152693A

United States Patent [19]

Matsui et al.

[11] Patent Number: 5,152,693

[45] Date of Patent: Oct. 6, 1992

[54] CLASP TO JOIN STRAPS CONTAINING AN ANTENNA FOR A PORTABLE INFORMATION DEVICE

[75] Inventors: Shigeru Matsui; Taeko Imai, both of Suwa, Japan

[73] Assignee: Seiko Epson Corporation, Tokyo, Japan

[21] Appl. No.: 842,730

[22] Filed: Feb. 26, 1992

Related U.S. Application Data

[63] Continuation of Ser. No. 07/636,832, Jan. 2, 1991, abandoned.

[30] Foreign Application Priority Data

| | | | |
|---|---|---|---|
| Jan. 10, 1990 | [JP] | Japan | 2-1049[U] |
| Jan. 22, 1990 | [JP] | Japan | 2-12101 |
| Mar. 7, 1990 | [JP] | Japan | 2-22967[U] |
| Aug. 18, 1990 | [JP] | Japan | 2-217732 |

[51] Int. Cl.[5] ..... H01R 33/18

[52] U.S. Cl. ..... 439/37; 24/68 J

[58] Field of Search ..... 439/37; 24/68 J, 69 J, 24/70 J, 71 J; 455/347, 344

[56] References Cited

U.S. PATENT DOCUMENTS

| | | | |
|---|---|---|---|
| 3,744,129 | 7/1973 | Dewey | 174/94 R X |
| 4,359,808 | 11/1982 | Fontaine | 24/71 J X |
| 4,696,054 | 9/1987 | Tsugei et al. | 455/344 X |
| 4,713,808 | 12/1987 | Gaskill et al. | 340/825.44 X |
| 4,894,649 | 1/1990 | Davis | 340/825.44 |

*Primary Examiner*—Eugene F. Desmond
*Attorney, Agent, or Firm*—Gregory D. Ogrod

[57] ABSTRACT

A clasp for a pair of wristbands on a digital watch having a pager with a radio frequency receiver such that the wristbands comprise an antenna that has its circuit completed and closed into a loop antenna when a user snaps the wristbands together with the clasp. The clasp has a catch shaft welded or soldered to a clasp body such that electrical contact between the antenna in the wristbands is thereby improved.

6 Claims, 5 Drawing Sheets

CLASP TO JOIN STRAPS CONTAINING AN ANTENNA FOR A PORTABLE INFORMATION DEVICE

This is a continuation of copending application Ser. No. 07/636,832, filed Jan. 2, 1991, now abandoned.

BACKGROUND OF THE PRESENT INVENTION

The present invention relates generally to wrist antenna/strap clasps and specifically to clasps used to fasten straps comprising a radio communication antenna for an electronic information device worn on the wrist of a user.

DESCRIPTION OF THE PRIOR ART

FIG. 1 illustrates a general sliding type clasp 10 that is described in Japanese Patent Office Bulletin 56(1981)-231[3213], *Commonly Known and Used Technologies.* A hook 11 is equipped with a closing cover 12 on the end of an antenna/strap 13 and is configured such that hook 11 and closing cover 12 each can swing freely, as indicated by A and B. They swing in a hinge shaft 14 that is attached to an anchor 15 secured to antenna/strap 13. Note that the electrical path from hook 11 to anchor 15 includes hinge shaft 14.

FIG. 2 illustrates an example of a prior art sliding type clasp device 20 for antenna/straps used with prtable information devices, such a pagers. A closing cover 21 hinges on a hinge shaft 22 (as indicated by A in FIg. 2) and is configured to elecrically connect to antenna element 23 via protrusions 24 existing on the bottom of a clasp body 25. Antenna element 23 is formed as a unit inside an antenna/strap 26. Clasp body 25 is fixed to antenna/strap 26. Closing cover 21 is fastened closed by sandwiching and holding a hook 27 on a hook unit 28. Hook 27 interlocks with a catch shaft 29 that mounts in clasp body 25. As shown is shown in FIG. 2, hook 27 is configured such that it can swing a little when the clasp is closed. Such swinging, however, makes the electrical contact of hook 27 to catch shaft 29 unstable while being worn by a user. Any freedom that catch shaft 29 has to move within its mounts to clasp body 25 will also distrub the electrical connection. Electrical conductivity between clasp body 25 and hook unit 28 is very unreliable with this configuration. Making matters worse, when dirt, dust perspiration, etc., adhere to the interlocking parts, the electrical resistance between them increases, and the assembly can intermittently fail to perfrom as a good loop antenna. Another problem is the way the closing cover 21 is attached to the clasp body 25, and the direction it swings when opened and closed. It is opposite to that of most common slide clasps. This tends to make it hard to put on or remove. Also, the closing cover is attached to the clasp body and has a hinge shaft side clearance meant to prevent any interference with the antenna/strap unit when it swings. But, the parts inside the clasp can be seen through the opening in the end (B in FIG. 2). This does not look very nice and can result on a dangerous condition by making it very easy to inadvertently catch things on the clasp. Since hook 27 has only a surface contact with catch shaft 29, a poor contact may result from deviations from the ideal shape that result during the fabrication of hook 27. The clasp will then not have the expected electrical conductivity that was assumed in the design. Precision matching technology and excessive matching processes are therefore required to accurately reproduce the right shape. Protrusions on the clasp body help to both position antenna/strap for length adjustments and to make electrical contact with the antenna element inside the antenna/strap. The anchoring pressure of an anchor claw attached inside the clasp body must therefore be adequate to maintain the electrical contact. Since the antenna antenna/strap is made from a synthetic resin or synthetic rubber, this pressure can cause permanent deformation over time. The deformation can result in long term unstable positioning, and can reduce the contact pressure which, in turn, will result in poor electrical contact. When a large stretching force is applied to a prior art antenna/strap, the antenna/strap may not be strong enough, because it is made from synthetic resin or synthetic rubber. Wells molded into the surface of the antenna/strap may become demaged by the protrusions (e.g., protrusions 24) on the clasp body, and make it impossible to keep the desired length.

An object of the present invention is therefore to offer a clasp device having the characteristics, quality, functionality, apperance, and serviceability necessary for a common wristband, such as used for a wristwatch, and a clasp that functions well as part of a loop antenna for transmitter and/or receiver operation of a portable information device in the form of a wristwatch.

SUMMARY OF THE PRESENT INVENTION

According to the present invention, a clasp for a pair of wristbands on a digital watch having a pager with a radio frequency receiver such that the wristbands comprise an antenna that has its circuit completed and closed into a loop antenna when a user snaps the wristbands together with the clasp.

An advantage of the present invention is that since two antenna/straps form a loop antenna with the help of a clasp device (unlike the prior art in that a rod antenna or wire antenna was attached to the outside of the portable information device) there is no need to attach an antenna to the ouside of the portable information device. The antenna elements are provided inside the antenna/strap, and a loop antenna is formed with the help of the clasp. A portable information device that is convenient to use is therefore made possible.

A further advantage of the present invention is that one or more protrusions are formed on a clasp body to interlock with a plurality of wells, formed on the inside surface of an antenna/strap such that a conductive thin metal palte (antenna element) exposed within the wells contacts the protrusion to provide a reliable electrical connection.

A further advantange of the present invention is that the length of the antenna/strap attached to a user's arm can be adjusted to the right size by changing the relative position of the wells on the antenna/strap to the protrusions on the main clasp unit.

A further advantage of the present invention is that since an antenna/strap is inserted between a keeper plate and protrusions formed on the clasp body, the antenna/strap is securely held in place by the pressure of an anchor claw against the keeper plate.

A further advantage of the present invention is that the main hook unit has a hook that is not a separate moveable piece of the hook unit. Instead, it is a fixed, single piece with the hook unit. This is unlike the prior art, where the hook and hook unit were formed of two separate pieces, and the electrical conductivity between the two members was thereby made unreliable. The present invention eliminates the intervening hinge in the electrical path, and electrical conductivity is therefore improved.

A further advantage of the present invention is that, unlike the prior art in which it is difficult to open the closing cover, in the present invention a hinge shaft is positioned the opposite side from the catch shaft. The end of the closing cover is positioned such that a it is easier to open and close.

A further advantage of the present invention is that the number of parts and machining processes are reduced, mainly in the clasp body and the clasp device. The device can be made more compact and is simplified. At the same time, the design prevents it from becoming entangled on objects inadvertently.

A further advantage of the present invention is that a catch shaft for a hook interlocks with either a line contact or a point contact. The shape of the hook does not need not to be made the same as the shape of the outside circumference of the catch shaft. This simplifies the production of the hook unit and makes it possible to produce it in volume and at low cost. Since a reliable, stable electrical connection is obtained, the electrical characteristics remain stable in spite of dirt, dust perspiration and other external factors. This is illustrated by the results in Table I that were obtained in a test by the present inventor that compared connection resistance with that in the prior art.

TABLE I

| | Initial value | Value after removing and reattaching 2000 times |
|---|---|---|
| Prior Art | 0.1 to 5.0 Ω | 1.0 to 20.0 Ω |
| Present Invention | 0.1 Ω | 0.1 to 0.2 Ω |

A further advantage of the present invention is that a catch shaft is fitted on a clasp body and is secured to the clasp body by soldering means to form a single unit. The prior art had the catch shafft merely fitted in holes in the clasp body, and that method results in unreliable electrical contacts. The connections in the present invention are very reliable and have no graps, this good electrical conductivity is maintained.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

FIG. 6 is an isometric view of an antenna/strap anchor claw used in the embodiment in FIG. 6.

DESCRIPTION OF THE PREFERRED EMBODIMENTS

Figure 1:
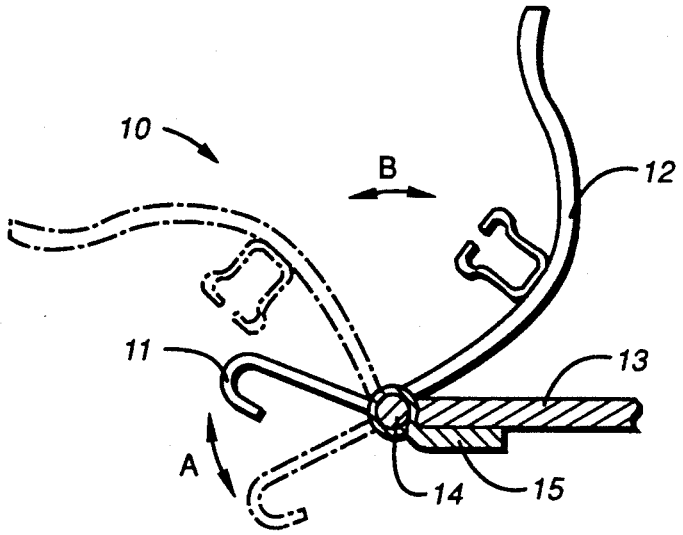
FIG. 1 (PRIOR ART)
FIG. 1 is a cross-section of a common prior art slide clasp type main hook unit.
Figure 2:
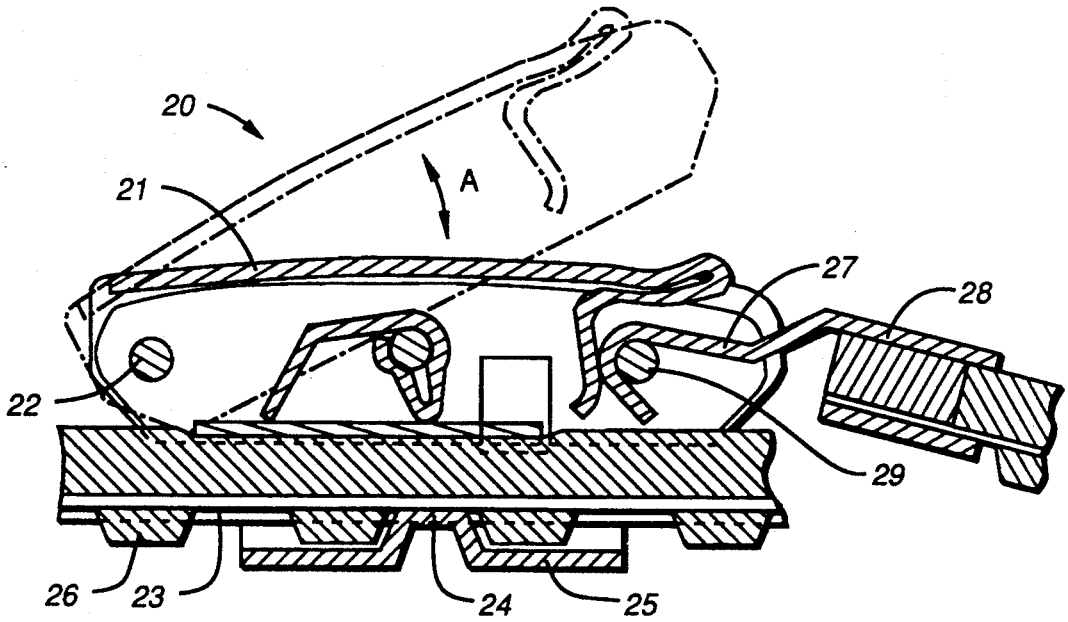
FIG. 2 (PRIOR ART)
FIG. 2 is an assembly cross-section along the center of a prior art antenna antenna/strap clasp device.
Figure 3:
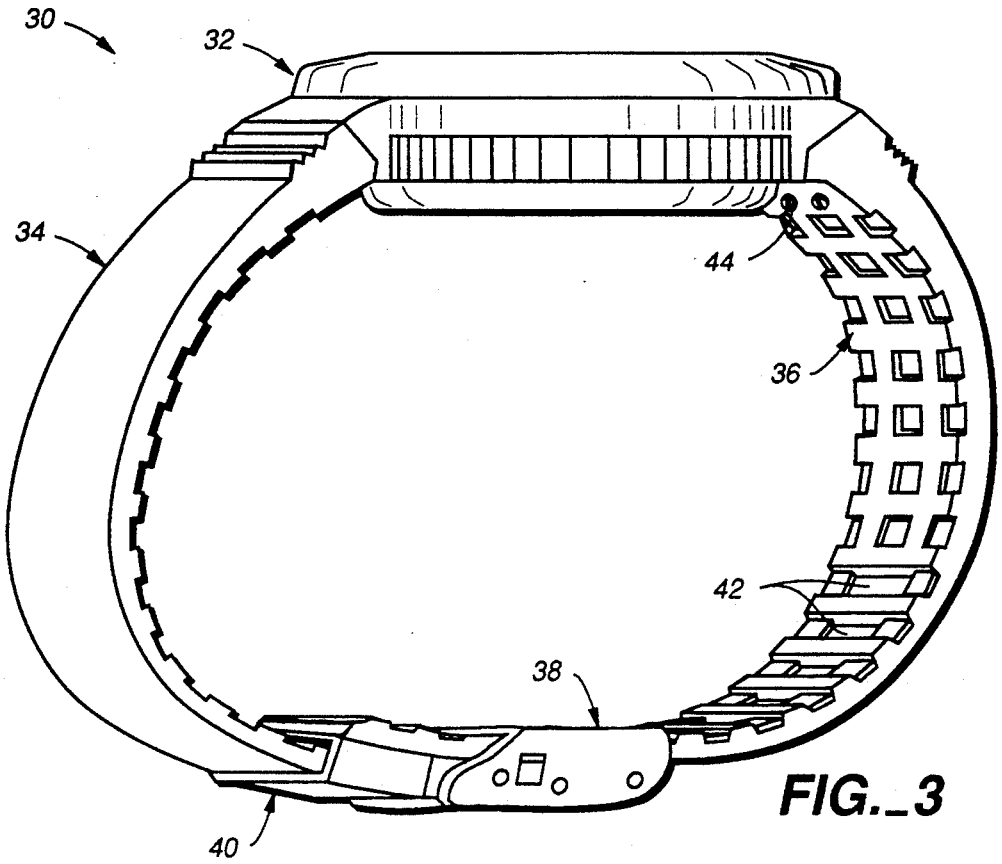
FIG. 3 is a prespective view of a portable information device embodiment of the present invention that has a clasp device used to join a pair of antenna/straps.

FIG 3 illustrates a portable information device 30 that may be worn on the wrist of a user. Device 30 comprises a case 32, a first antenna/strap 34, a second antenna/strap 36, a main clasp unit having a clasp body 38, and a main hook unit 40. If device 30 were a wristwatch, the first antenna/strap 34 is attached to the case 32 at the 12 o'clock position. The second antenna/strap is attached to case 32 at the 6 o'clock position. Antenna/strap 36 has a plurlity of wells 42 that expose an antenna comprised of a metal conductor. Antenna/strap 36 is attached to case 32 by screws 44. Antenna/strap 34 is similarly attached to case by screws 44 (not visible in FIG. 3). The clasp device comprises the main clasp unit 38 electrically connected and mechanically fastened to second antenna/strap 42, and a main hook unit 40 electrically connected and mechanically fastened to the first antenna/strap 34. Units 38 and 40 interlock and allow the clasp device to be repeatedly disengaged and reengaged. When the clasp device is engaged, the first and second antenna/straps are electrically connected to form a loop antenna.

Figure 4:
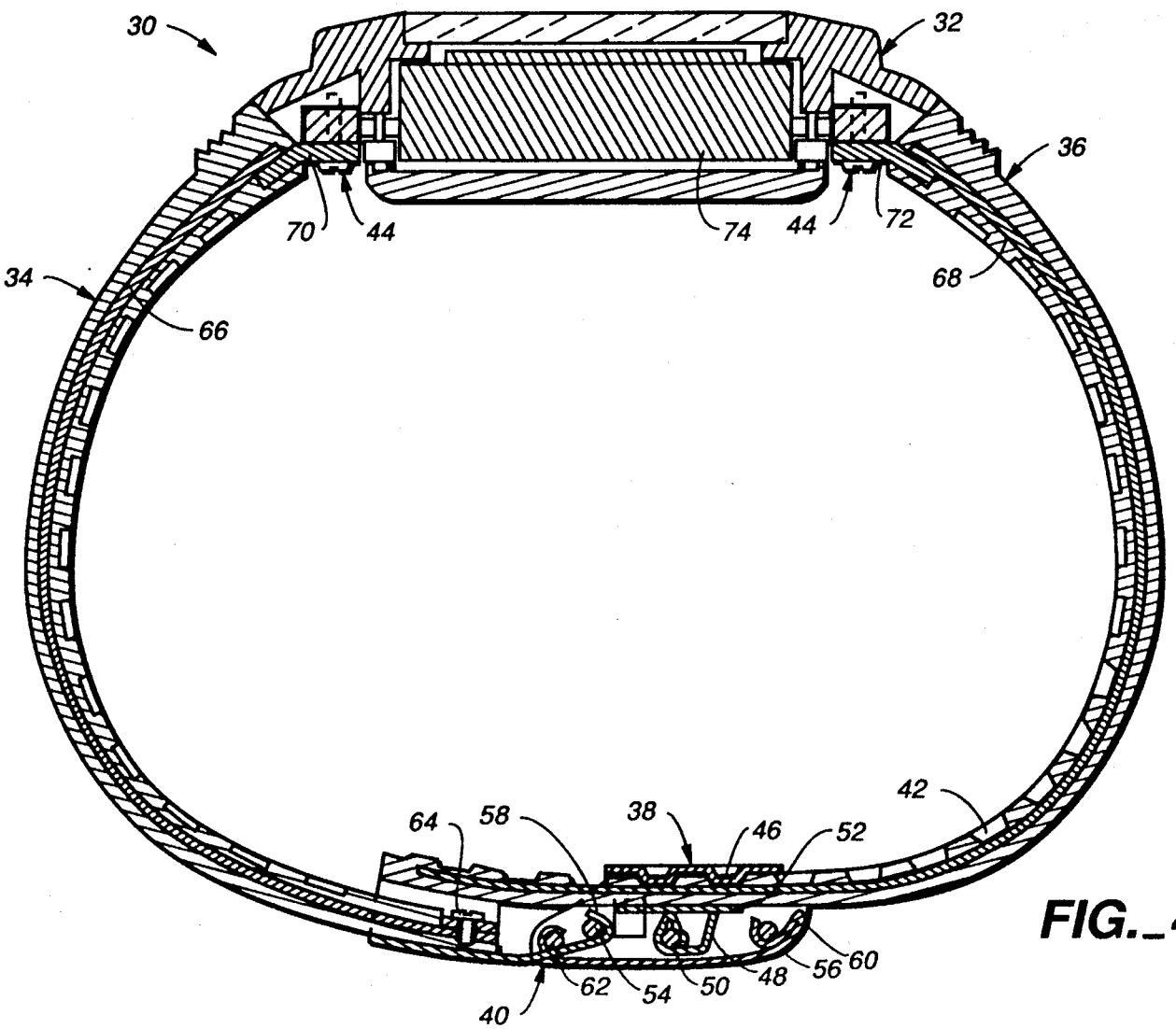
FIG. 4 is an assembly cross-section taken along the longitudinal centralizes of the device in FIG. 3.
Figure 16:
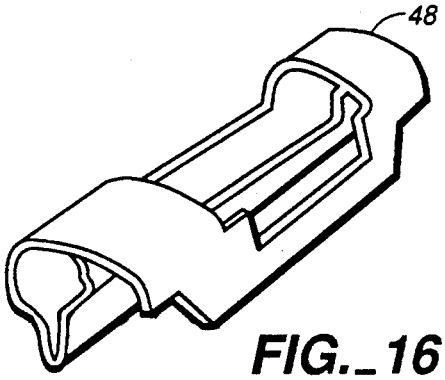

Referring to FIG. 4, the main clasp unit comprises the clasp body 38 having one or more protrusions 46 that mate with the plurality of wells 42 formed on one surface of the second antenna/strap 36, an anchor claw retainer shaft 50 positioned such that there is a grap between it and the protrusions 46, the gap such that antenna/strap 36 can slip within, an antenna/strap anchor claw 48 fitted on an anchor claw retainer shaft 50 such that it rotates freely and can lock the second antenna/strap 36 in the gap between a keeper plate 52 and protrusions 46, a catch shaft 54 that is positioned away from the anchor claw retainer shaft 50 such that it does not interfere with the functions of the antenna/strap anchor claw 48, and a closing cover anchor shaft 56. (Anchor claw 48 is show in an isometric view in FIG. 16) Main hook unit 40 comprises an integrated hook 58 that interlocks with the catch shaft 54 such that it can be readily disengaged from the main clasp unit. A closing cover 60 is attached to a hinge shaft 62 such that it can rotate freely and can snap closed with the closing cover anchor shaft 56. Main hook unit 40 electrically connects to and is mechanically fastened with antenna/strap 34 by screws 64. Antenna/straps 34 and 36 are preferably made from a synthetic resin/rubber such as polyurethane rubber, vinyl chloride or silicon rubber, and formed as a unit with flat metal conductors 66 and 68. Anchors 70 and 72 provide means to mount and connect antenna/straps 34 and 36, respectively, to case 32. The interlock between the hook 58 and catch shaft 54 makes a contact along at least one line along the cylindrical surface of catch shaft 54. Alternatively, the contact could be a point contact made so by altering the shape of catch shaft 54. To imprive the electrical connection of the catch shaft 54, the clasp body 38 si welded or soldered to the catch shaft 54 such that they become a single unit. FIG. 4 demonstrates how a loop antenna is configured by fastening the two antenna/-straps 34 and 36. The loop antenna is formed by the conductive path comprising anchor 70, conductor 66, hook unit 40, hook 58, catch shaft 54, clasp body 38, positioning protrusions 46 in contact with wells 42, conductor 68, and anchor 72. Case 32 contains a device 74 that comprsies a radio frequency receiver and/or transmitter. In a preferred embodiment, device 74 comprises a pager unit that receives electronic codes by radio frequency transmission to notify the user of attempts to telephone or otherwise contact the user. The size of wrist that device 30 wii fit can be adjusted by changing the position of the main clasp unit on atenna/-strap 36. Claw 48 is rotated to release the pressure on keeper plate 52 such that antenna/strap 36 can slip back and forth. At the desired position, protrusions 46 will settle into new wells 42 and electrical contact between clasp body 38 and conductor 68 will be established by rotating claw 48 back into its locked position.

Figure 5:
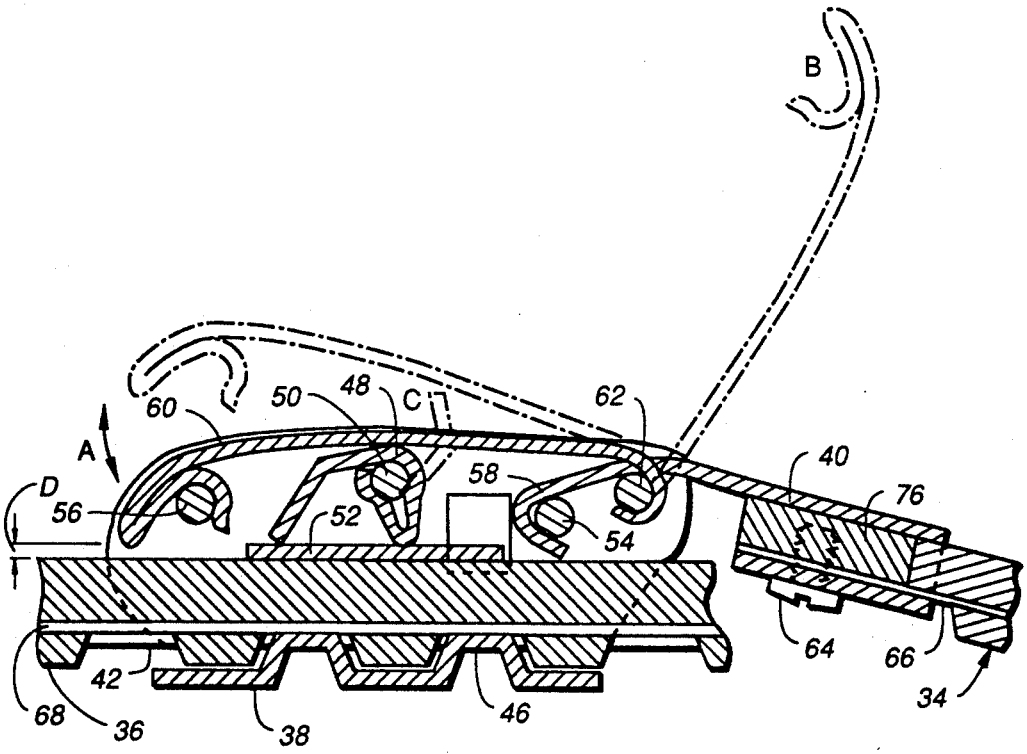
FIG 5 is an assembly cross-section of the clasp device of the present invention shown in FIG. 3 and FIG. 4.
Figure 7:
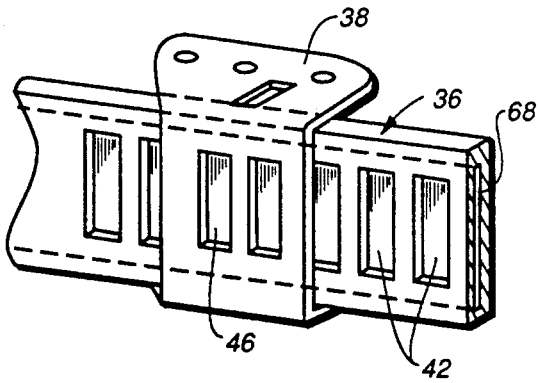
FIG. 7 is an isometric view of the clasp body in FIGS. 3 and 4 showing the attachement of it to the second antenna/strap.

In FIGS. 5 and 7, wells 42 can be seen to be formed such that parts of conductor 68 are exposed at a uniform depth from the inside surface of antenna/strap 36. Protrusions 46, used in part for positioning, are slightly smaller in diameter than the inside contour of wells 42 and have the same pitch as wells 42. Protrusions 46 are formed inside of clasp body 38. Clasp body 38 is secured to the second antenna/strap 36 and houses the closing cover anchor shaft 56, catch shaft 54, keeper plate 52, and antenna/strap anchor claw 48 on anchor claw retainer shaft 50. Catch shaft 54 is secured to clasp body 38 by caulking, soldering, or welding, in order to form a single unit such that electrical conductivity is improved and clasp body 38 is made stronger. Part of conductor 66 is exposed and may be reinforced by welding, soldering or screwing (e.g., screws 64) on a member 76, which is preferably made from the same material as is conductor 66.

Figure 6:
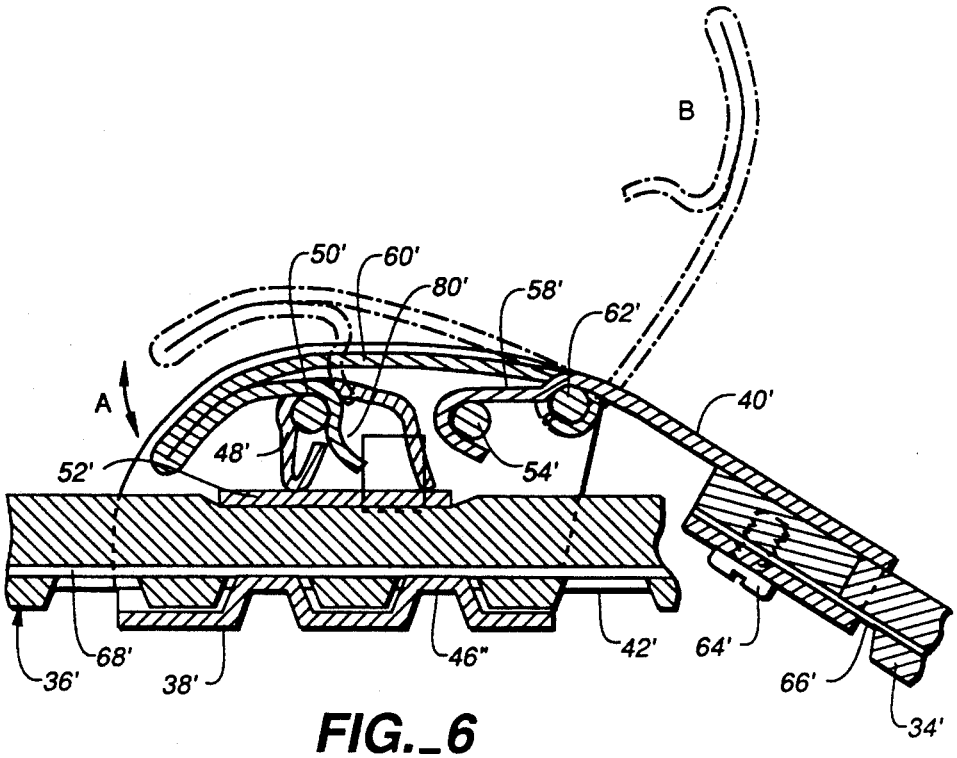
FIG. 6 is an assembly cross-section of an alternative embodiment of the clasp device.

FIG. 6 shows an alternative that eliminates closing cover shaft 56 by combining its function with anchor shaft 50. All other details are the same as described above, except that claw 80 and closing cover 60 are modified to use use shaft 50 instead of shaft 56 to snap the cover 60 closed. (Primes on element numbers are used here to denote a similarity with the non-prime element numbers of previous FIGS.) In this and all other embodiments, a conductive metal is preferably used in the clasp devices described, and the metal should be a nonmagnetic, highly conductive material, such as stainless steel, copper, beryllium copper, phosphor bronze, nickel-silver, aluminum, gold, silver, palladium, etc. The surface of the metal material can be treated with one or more layers of gold, silver, palladium, rhodium, nickel or other material, by electrolytic or non-electrolytic method. The surface can be treated by ion plating with gold or tin alloy, in one or two or more layers in conjunction with the above surface treatment, or alone. The surface of the metal can be finished with a brushed, honed or mirror surface to improve its appearance, and engravings, markings, and/or other treatments to improve the appearance of the product can be made without interfering the functioning of these embodiments of the present invention.

FIG. 7 shows clasp body 38 secured to the second antenna/strap 36 as described above. Wells 42 are shown engaged with the protrusions 46 for positioning of and electrical contact with clasp body 38.

Figure 8:
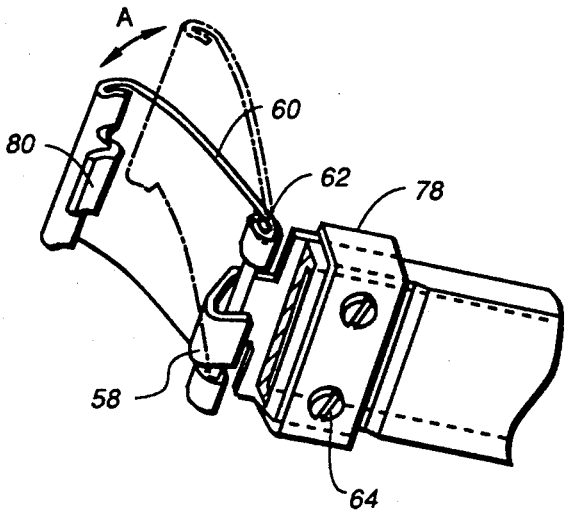
FIG. 8 is an isometric view of the hook unit in FIGS. 3 and 4 attached to the first antenna/strap.

FIG. 8 shows an alternative embodiment having a reinforcing band 78 that wraps around the exposed end of conductor 66 and member 76, and is held in place with screws 64. Slotted-head, Phillips-head, countersunk-head, or oval-head machine screws can be used for screws 64. Hook 58 is formed as a fixed, integral extension of hook unit 40, and is formed such that it can interlock with catch shaft 54. The shape of hook 58 can be made to conform to the axial shapes described above for catch shaft 54. Hook 58 is not limited to the "r" shape of this exemplary embodiment. Closing cover 60 has a cupped claw 80 at its end for snap-interlocking with shaft 56. Closing cover 60 swings on hinge shaft 62 and is capable of swinging through position A to the maximum position B, shown in FIG. 5. In FIG. 8, hook 58 is between the hinge attachments of cover 60 to hinge 62. Alternatively, the hinging of cover 60 could be at the center with the metal bridge from unit 40 to hook 58 running around either side of hinge 62. Hinge 62 has steps that prevent it from slipping out of position. Cupped claw 80 snaps onto a clasp body 38 and is formed as a single integrated unit with closing cover 60. Cupped claw 80 may also be a separate unit made of especially hard material to improve durability. Closing cover 60 is pressed down such that cupped claw 80 snaps onto and clasps closing cover anchor shaft 56. To release closing cover 60, the user pries open gap D (between the end of closing cover 60 and antenna/strap 36) and lifts up. Anchor shaft 56 then will release cupped claw 80.

Figure 9:
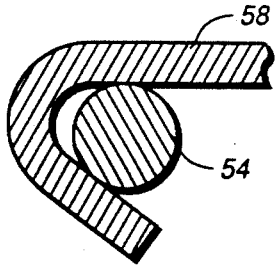
FIG. 9 is a cross-section detail of the hook interlocked with the catch shaft of the device in FIGS. 3 and 4.
Figure 10:
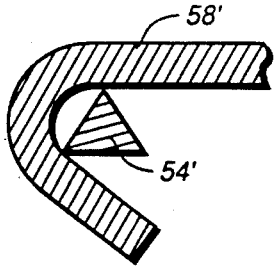
FIGS. 10 and 11 are shaft corss-sections showing alternative cross-section shapes of other catch shafts alternative to the cylindrically shaped one shown in FIG. 9.
Figure 11:
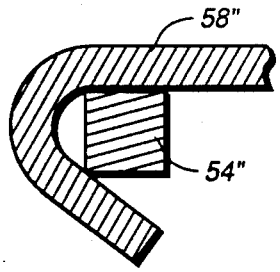
Figure 12:
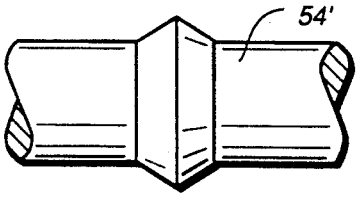
FIGS. 12 and 13 are cross-sections in the axial direction of the catch shaft of FIG. 9 showing alternative catch shaft shapes.
Figure 13:
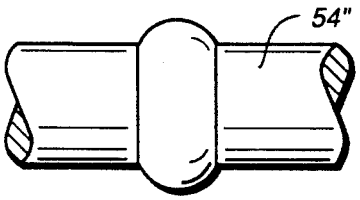

In the embodiment shown in FIG. 9, catch shaft 54 is shown as being a cylinder (having a round cross-section). Alternatively, catch shaft 54 may be triangular in cross-section, as shown in FIG. 10, or square, as shown in FIG. 11. Catch shaft 54 may even be pentagonal, polygonal, or elliptical in cross-section. Different shapes will affect the electrical contact properties of the connection of catch shaft 54 with hook 58. Likewise, the axial shape of catch shaft 54 may be straight, or it may be stepped as shown in FIGS. 12 and FIG. 13. The contact properties may be improved by using gold and-/or silver plating at the point of contact, e.g., where catch shaft 50 touches hook 58 and where protrusions 46 touch conductor 68 in wells 42.

The shape of protrusions 46 on the clasp body 38 are preferably rectangular with a trapezoidal cross-section. But as long as the functions of positioning of the clasp body and maintaining the anchor strength of the antenna antenna/strap and electrical conductivity are satisfied, protrusions 46 may be variously shaped as barrels, polygons, or cylinders.

Figure 14:
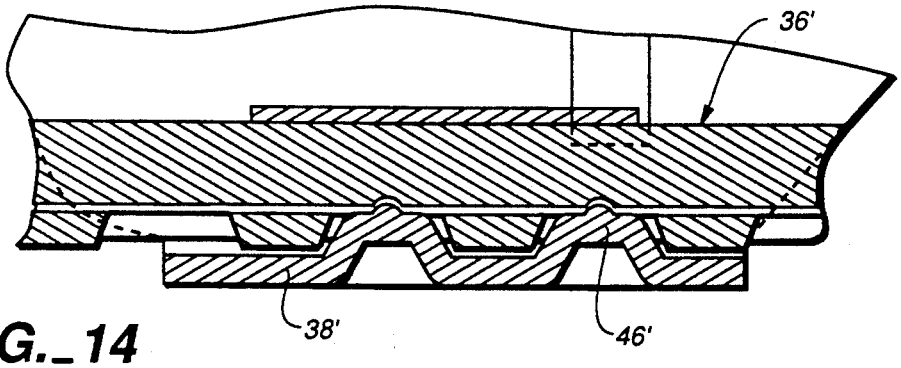
FIG. 14 is a partial longitudinal cross-section of the device of FIG. 3 showing that small protrusions having conical shapes in the clasp body make a point contact within a plurality of wells within the second antenna/-strap.

In an alternative embodiment shown in FIG. 14, the shape of protrusions 46' have been enhanced by a small cone-shaped tip "A" which is placed at the tops of one or more of protrusions 46'. (Primes on element numbers are used here to denote a similarity with the non-prime element numbers of previous FIGS.) Clasp body 38' is secured to antenna/strap 36', principally by a point contact.

Figure 15:
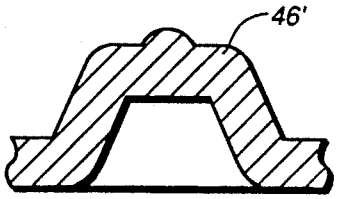
FIG. 15 is a cross-sectional detail of a single protrusion representing an alternative embodiment to the protrusions on the clasp body in FIG. 14. In this alternative embodiment, the small protrusion have rounded rather than pointed tips.

In another embodiment shown in FIG. 15, the cross-sectional shape of the small protrusion A shown in FIG. 14 is a circular arc like that indicated by A in FIG. 15. The small protrusions of the embodiments shown in FIGS. 14 and 15 can also be used with protrusions whose cross-section are barrel shaped, polygonal shaped or cylindrically shaped, as mentioned above in the discussion referring to FIG. 5. These alternative configurations can offset the effects of permanent deformation of the antenna/strap caused by the holding pressure of the keeper plate. Furthermore, damage to the positioning wells 42 can be reduced by the above alternative protrusion 46 configurations.

While the present invention has been described in conjunction with several specific embodiments, it will be evident to those skilled in the art that many further alternatives, modifications and variations in light of the foregoing description. The present invention described herein is intended to embrace all such alternatives, modifications, applications and variations as may fall within the spirit and scope of the appended claims.

What is claimed is:

1. A clasp device for electrically connecting antennae/straps use on portable information transfer devices having a case and combination antenna and user support straps extending outward from opposite sides of the case, each antenna/strap having a soft pliable material formed over a thin conductive material used as a portion of a loop antenna to be completed by the clasp, the clasp comprising:

a clasp base electrically connected and mechanically fastened to a first antenna/strap, comprising:

a clasp body having two or more protrusions configured to interlock with a plurality of wells formed on one surface of the first antenna/strap and make electrical contact with the conductive material inside the first antenna/strap;

a keeper plate positioned to press against the first strap from a side opposite the protrusions and retain the first antenna/strap in position against the protrusions;

an antenna/strap anchor claw rotatably mounted on an anchor claw shaft secured to the clasp body, being freely rotated between at least one open position away from the keeper plate and a closed position in pressure contact with the keeper plate so as to press the keeper plate against the first antenna/strap; and a catch shaft immovably secured to the clasp body, spaced apart from and parallel to the anchor claw shaft so as to not interfere with rotation of the anchor claw;

a hook unit that interlocks with and fastens in disengageable fashion to the clasp base and electrically connects and mechanically fastens to the second antenna/strap, comprising:

an integrated hook body having a first hook extending out and removably hooking around the catch shaft, said body being secured to an end of the second antenna/strap and maintaining electrical contact therewith, a cover hinge shaft mounted on the hook body adjacent a base of the first hook; and a closing cover rotatably attached to the cover hinge shaft such that it rotates freely about the hinge shaft and is positioned over the first hook, said cover having a second hook extending downward from one surface that removably interlocks with a closing cover anchor shaft disposed on the clasp body, and makes the first hook non-removable when the hook unit interlocks with the clasp body.

2. The clasp of claim 1 wherein said integrated hook body comprises a metallic plate having two fastening ears extending from opposite edges which are bent over outer edges of said second antenna/strap and secured thereto using electrically conductive fasteners extending into contact with the conductive material within, and a hook tongue extending toward the catch shaft over the cover hinge and under the cover.

3. The clasp of claim 2 wherein said electrically conductive fasteners comprise a pair of metallic screws positioned in threaded apertures that extend through the fastening ears, whereby secure attachment to the second antenna/strap is obtained with a removable body.

4. The clasp of claim 1 wherein said second hook on the closing cover interlocks with the cover anchor shaft so as to make the hook body non-movable about the catch shaft.

5. The clasp of claim 1 wherein said closing cover anchor shaft comprises the anchor claw shaft.

6. The clasp of claim 4 wherein said anchor claw has a surface positioned adjacent said catch shaft when in a closed position which inhibits removal of the first hook and a slot in that surface for insertion of the hook during engagement with the catch shaft.

* * * * *